United States Patent [19]

Müller et al.

[11] Patent Number: 4,740,279

[45] Date of Patent: Apr. 26, 1988

[54] PROCESS AND APPARATUS FOR PRODUCING HIGH-PURITY LITHIUM METAL BY FUSED-SALT ELECTROLYSIS

[75] Inventors: Jürgen Müller, Karben; Richard Bauer, Bad Vilbel; Bernd Sermond, Asslar; Eike Dolling, Goslar, all of Fed. Rep. of Germany

[73] Assignee: Metallgesellschaft Aktiengesellschaft, Frankfurt am Main, Fed. Rep. of Germany

[21] Appl. No.: 907,069

[22] Filed: Sep. 12, 1986

[30] Foreign Application Priority Data

Sep. 14, 1985 [DE] Fed. Rep. of Germany ..... 3532956

[51] Int. Cl.[4] ..... C25C 3/02

[52] U.S. Cl. ..... 204/68; 204/243 R; 204/245; 204/246; 204/247

[58] Field of Search ..... 204/68, 69, 70, 243 R, 204/245, 246, 247

[56] References Cited

U.S. PATENT DOCUMENTS

| | | | |
|---|---|---|---|
| 2,862,863 | 12/1958 | Griffith | 204/227 |
| 3,396,094 | 8/1968 | Silvilotti et al. | 204/247 |
| 3,962,064 | 6/1976 | Brut et al. | 204/68 |
| 4,420,381 | 12/1983 | Silvilotti et al. | 204/247 |

FOREIGN PATENT DOCUMENTS

| | | |
|---|---|---|
| 0096990 | 12/1983 | European Pat. Off. . |
| 0107521 | 2/1984 | European Pat. Off. . |
| 2560221 | 8/1985 | France . |

OTHER PUBLICATIONS

European Search Report 0217438 dated 12 Mar. 86.

*Primary Examiner*—T. Tung
*Assistant Examiner*—Ben C. Hsing
*Attorney, Agent, or Firm*—Karl F. Ross; Herbert Dubno

[57] ABSTRACT

This invention relates to a process of producing lithium metal by the electrolysis of fused mixed salts comprising electrolyzing fused mixed salts consisting of lithium chloride and potassium chloride in a diaphragmless electrolytic cell, withdrawing molten lithium metal from the cell to a receiver and cooling the lithium metal which has been withdrawn. To decrease the content of impurities in a continuous process, molten mixture which rises in the interelectrode space in the cell and contains lithium metal is collected in an annular zone, which surrounds the top end of the cathode adjacent to the surface level of the molten mixture, said molten mixture is withdrawn from said annular zone through a siphon pipe and is supplied from the latter to a separating chamber, which communicates with the electrolytic cell and is sealed from the chlorine gas atmosphere in the electrolytic cell, electrolyte and lithium are separated in the separating chamber under a protective gas atmosphere, lithium metal is discharged from the separating chamber into a receiver under a protective gas atmosphere, and the electrolyte is recycled from the separating chamber to the electrolytic cell. An electrolytic cell for carrying out the process is also described.

6 Claims, 1 Drawing Sheet

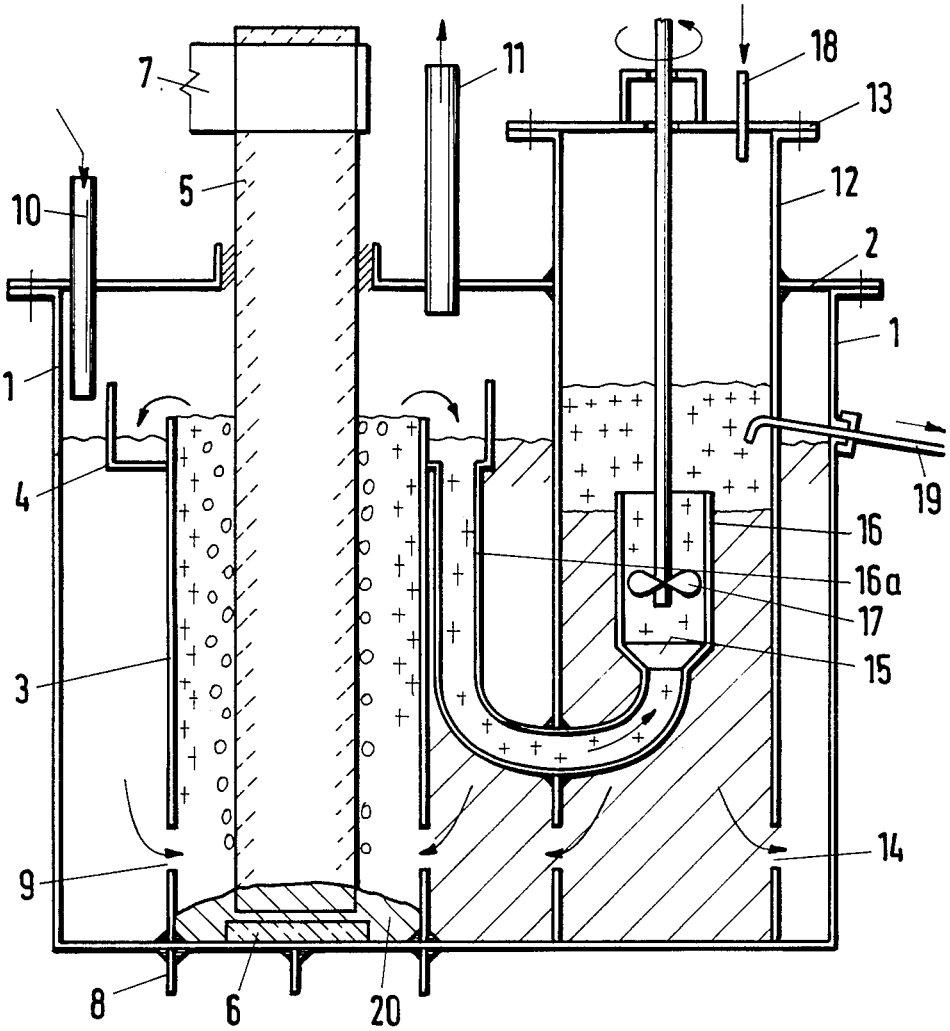
7
11
18
13
10
5
12
2
1
1
4
19
16
16a
17
15
3
14
9
8
6
20

PROCESS AND APPARATUS FOR PRODUCING HIGH-PURITY LITHIUM METAL BY FUSED-SALT ELECTROLYSIS

FIELD OF THE INVENTION

This invention relates to a process of producing high-purity lithium metal by fused-salt electolysis and to an electrolytic cell for carrying out the process.

BACKGROUND OF THE INVENTION

In commercial practice, lithium metal is produced by the electrolysis of a molten mixture of lithium chloride serves in known manner to reduce the melting point of lithium chloride. Suitable electrolytic cells are, e.g., cells having no diaphragm. Such cells have a steel vessel, a steel cathode and a graphite anode and have no internal lining. The molten lithium metal accumulates on the surface of the molten salts and is skimmed from said surface by means of a skimming ladle or may be withdrawn by elevators. As chlorine gas is evolved and escapes from the cell, air will enter the cell so that the liquid metal may be oxidized and nitrided. Published European Patent Publication No. 107 521 discloses a process for the continuous production of lithium metal by an electrolysis of lithium chloride contained in a molten salt mixture an electrolytic cell comprising a cylindrical steel cathode, which has been inserted into the bottom of the cell, and a graphite anode, which is immersed into the molten material in the cell. In that known process, the molten salt mixture which contains lithium metal is withdrawn from the cell and the lithium metal is separated outside the cell. Because chlorine gas is evolved and the end of the cathode is formed like a venturi tube, a natural circulation is imparted to the molten material. A further reaction of lithium metal in the molten mixture is to be avoided.

Impurities of whatever kind are highly undesirable in the lithium metal if it is to be used in nuclear technology in the production of alloys and in lithium batteries.

For this reason it is known from U.S. Pat. No. 3,962,064 in the production of high purity lithium metal to perform the fused-salt electrolysis in an electrolytic cell which has no diaphragm and in which the lithium metal which has separated is collected on the surface of the electrolyte and the electrolyte level is raised so that the metal is forced out of the cell through a system of overflows and is conduced to a receiver. The receiver contains a protective gas atmosphere, in which the liquid lithium metal having a purity of 99.9% is cast to form ingots. That known apparatus has the disadvantage that the equipment is expensive and that air is used in the known process as a pressure fluid for raising the level of the electrolyte (and of the metal). Besides, the chlorine gas which is evolved is diluted with a large volume of air and is blown out of the cell together with this volume of air. This has the result that oxygen or air is inherently introduced into the system as an impurity, which is undesirable.

OBJECT OF THE INVENTION

It is an object of the invention to provide a process for producing high-purity lithium metal and also to provide a suitable apparatus for carrying out the process.

SUMMARY OF THE INVENTION

In a process for producing lithium metal by the electrolysis of fused mixed salts comprising electrolyzing fused mixed salts consisting of lithium chloride and potassium chloride in a diaphragmless electrolytic cell, withdrawing molten lithium metal from the cell to a receiver and cooling the lithium metal which has been withdrawn, we can accomplish this object in that the molten mixture which rises in the interelectrode space in the cell and contains lithium metal is collected in an annular zone which surrounds the top end of the cathode adjacent to the surface level of the molten mixture, the collected molten mixture is withdrawn from said annular zone through a siphon pipe and is supplied from the latter to a separating chamber which communicates with the electrolytic cell and is sealed from the chlorine gas atmosphere in the electrolytic cell, electrolyte and lithium are separated in the separating chamber under a protective gas atmosphere, lithium metal is discharged from the separating chamber into a receiver under a protective gas atmosphere, and the electrolyte is recycled from the separating chamber to the electrolytic cell.

The lithium metal which has been discharged into the receiver is processed further in known manner and, for instance, is cast to form ingots. The electrolyte is circulated in the electrolytic cell and is recycled from the separating chamber to the interelectrode space. Chlorine gas evolved at the anode is sucked from the covered gas space over the molten material and is recovered as chlorine gas or in the form of salts. The chlorine gas stream is suitably sucked through an absorber, which is also supplied with a lithium hydroxide slurry and this slurry is also treated with ammonia as a reducing agent so that the reaction $$6\ LiOH + 3\ Cl_2 + 2\ NH_3 \rightarrow 6\ LiCl + N_2 + 6\ H_2O$$

is performed. The lithium chloride thus recovered is reused as a raw material for the electrolysis.

In the process in accordance with the invention it is essential to cause the metal-containing electrolyte to flow in the siphon pipe toward and into the separating chamber and to ensure that the mixture of metal and fused salts rising in the interelectrode space is withdrawn into the separating chamber as quickly as possible. This means that a separation in the interelectrode space must be inhibited; such separation might be the result of an inadequate velocity of flow out of the cell. The velocity of flow must not be so high that chlorine gas or air can be entrained into the separating chamber. By a controlled immersion of a neutral body into the molten electrolyte the surface of the molten electrolyte can be maintained on a desired level. In the practice of the process in accordance with the invention, a given portion of the rising molten mixture of metal and fused salts will remain on the surface of the bath for about 2 seconds or less. The flow of the electrolyte is due at least in part to the gas-lift pump action of the rising chlorine gas and may be assisted by a pumping action which is produced by mechanical means in the shorter leg of a siphon pipe which connectes the interelectrode space or annular space to the separating chamber. Suitable mechanical means for producing a flow of the electrolyte may consist of known mechanical equipment, such as pumps or stirrers. When a buffer volume of liquid lithium metal which has been purified by segregation has been built up in the separating chamber, the lithium is continuously discharged from the separating chamber into a receiver and is, e.g. cast and permitted to cool therein. A protective gas atmosphere consisting, e.g., of argon is maintained in the separating chamber above the surface of the molten material.

The invention provides also an electrolytic cell for carrying out the process in accordance with the invention.

That electrolyte cell is a cell of the kind described hereinbefore for the electrolytic recovery of lithium metal. In that electrolytic cell, a steel cathode is welded to the bottom of a closed cylindrical steel vessel, a vertical graphite anode is sealed from the atmosphere and has a portion which is surrounded by the cathode and immersed into the molten salt mixture, and means are provided for supplying lithium chloride, protective gas and electrical power to the cell and for discharging lithium metal and chlorine gas from the cell.

In a further development of an electrolytic cell of the kind described the improvement in accordance with the invention resides in that a steel cylinder which is closed at its top is eccentrically disposed in the steel vessel of the electrolytic cell and rises above said steel vessel and rests on the bottom of the steel vessel and is provided in the lower portion of its cylindrical shell with a substantially U-shaped pipe, which extends through and is welded to said cylindrical shell and has a lower leg which centrally opens in the steel cylinder, and a longer leg, which opens in an annular trough, which surrounds the top end of the steel cathode, and said cylindrical shell is formed with apertures in its lower portion.

The steel cylinder constitutes a tubular separator in which liquid lithium metal and molten electrolyte are separated from each other. For this reason the tubular separator has a small diameter, which is about 1/10 of the diameter of the cell vessel. The siphon pipe communicates at one end with the interior of the electrolytic cell, specifically with the annular trough which surrounds the top rim of the cathode, and communicates at the other end with the tubular separator. That siphon pipe has an important function because it serves as an overflow pipe. In order to produce at the inlet of the U-shaped pipe a pump-induced swirl and a flow toward the tubular separator, a mechanical conveyor is provided in the shorter leg of the siphon pipe. For the purposes of the invention such mechanical conveyor may consist of a stirring mechanism, such as a propeller stirrer, a conveyor screw or a centrifugal pump. The drive means and suitably also an inlet for a protective gas extend through the top cover.

For a rapid withdrawal of the mixture of molten metal and molten salts from the collecting trough in a downward direction it will generally be sufficient to provide a siphon pipe which has the same diameter throughout its length, i.e., in its longer and shorter legs. In accordance with a further feature of the invention the longer leg or intake pipe is smaller in diameter than the shorter leg. In that embodiment of the invention the upper portion of the shorter leg is enlarged to constitute a cylindrical portion which is larger in diameter. The ratio of the small diameter to the large diameter is generally from 1:2 to 1:12, preferably from 1:5 to 1:10.

The graphite anode extends into the cell vessel through the cover thereof and may be secured to the cover and depend into the cathode space. It is desirable, however, so to arrange the graphite anode that it is easily detachable and extends through and is insulated from the cover and is supported by an electrically insulating fitting on the steel bottom of the vessel. Such insulating fitting may suitably be made of a ceramic oxide, such as fused alumina. During the operation of the cell the insulating fitting is suitably covered by molten salts which have solidified so that the tubular fitting will be protected from the corrosive attack of the molten electrolyte.

The graphite anode may consist of a solid slab or solid cylinder and the cathode may consist of a hollow box or a hollow cylinder. The same potential is applied to the cathode and to the cell vessel. The negative terminal of the voltage source is connected to the bottom of the cell vessel.

During the practical operation of the electrolytic cell the top rim of the cathode is disposed above the surface of the molten electrolyte. An annular collecting trough surrounds and is attached to the outer edge of the cathode and receives the rising electrolyte, which contains lithium metal and is directly discharged from said collecting trough through an opening formed in the bottom of the trough to the long leg of the siphon pipe. The conveying force results in the first place from the mammoth pump action of the rising chlorine gas. The top rim of the cathode is serrated, as is usual with overflow rims, in order to facilitate the overflow of the metal-containing mixture of molten salts.

BRIEF DESCRIPTION OF THE DRAWING

The invention will now be explained more in detail with reference to an Example and to the drawing.

The sole FIGURE of the accompanying drawing is a diagrammatic section through an apparatus in accordance with the invention.

The vessel 1 of the electrolytic cell is closed by a cover 2 and contains a cathode 3, which is welded to the bottom of the vessel 1. The cathode 3 is provided at its top rim with a trough 4 for collecting the overflowing molten salts, which contain lithium metal. The graphite anode 5 extends through the cover 2 and is supported by an insulator 6 on the bottom of the vessel 1. The anode 5 is surrounded by the cathode 3. Terminals 7 and 8 are respectively connected to the positive and negative poles of a d.c. voltage source. The molten electrolyte can circulate through apertures 9 provided in the lower portion of the cathode wall. Make-up lithium chloride is charged through the pipe 10 into the molten salt mixture. Evolved chlorine gas escapes through the outlet 11. The electrolytic cell contains also a tubular separator 12, which is closed by a cover 13 and welded in the cover 2 of the electrolytic cell and rises above the vessel 1 and extends downwardly as far as to the bottom of the vessel 1. Apertures 14 formed in the lower portion of the tubular separator 12 permit molten salt to flow from the tubular separator into the remaining molten electrolyte. The tubular separator 12 communicates through the siphon pipe 15 with the collecting trough 4. The longer leg **16*a* of the U-shaped pipe 15 extends into the bottom of the collecting trough 4. The opening of the shorter leg is enlarged to a larger pipe diameter or leg at 16. The leg 16 contains a stirrer 17 which comprises a shaft that extends through the cover 13 of the tubular separator 12. The cover 13 is also provided with an inlet 18 for a protective gas. Molten lithium is discharged from the tubular separator through a pipe 19. The insulating fitting 6 is covered by solidified fused material 20** for protection against the corrosive action of the molten material.

SPECIFIC EXAMPLE

The electrolyte used in the process in accordance with the invention consists of a eutectic salt mixture of about 50% by weight lithium chloride and about 50% by weight potassium chloride. The operating temperature is 400° C. and the current density 5,000 to 10,000 amperes per $m^2$, preferably 6,000 amperes per $m^2$. The cell voltage is 6.2 to 9.2 volts. The current efficiency is in excess of 90%. The current efficiency is in excess of 90%. The vessel and the cathode are made of normal structural steel. The vessel has a wall thickness of about 20 mm and has no ceramic lining. The electrographite anode extends centrally in the cathode space. The interelectrode distance is about 50 mm. Chlorine which is evolved at the anode during the operation of the cell is collected in the gas space above the molten salts and is removed from the cell under a small subatmospheric pressure. The molten salt mixture which contains lithium metal and rises from the interelectrode space flows over into the collecting trough, in which part of the lithium metal rises to the surface together with a large quantity of fused salts is immediately conveyed to the inlet of the siphon pipe at a high velocity of flow. The high velocity of flow in the U-shaped pipe is generated by a blade stirrer. In the tubular separator, lithium metal is separated under an argon atmosphere from the molten salt mixture, which contains lithium metal, and the separated lithium metal rises to the surface. The molten salt mixture flows downwardly in the tubular separator and is then recirculated. After other impurities have been removed from the collected molten lithium metal by segregation, the molten lithium metal is continuously or intermittently discharged and is then processed further under suitable conditions, e.g., under a protective gas atmosphere or in a vacuum. The high-purity lithium metal produced by the process in accordance with the invention has the following analysis:

| | | | |
|---|---|---|---|
| Na | 30 ppm | Mg | <10 ppm |
| K | 40 ppm | Al | <10 ppm |
| Ca | 60 ppm | Sr | <10 ppm |
| Fe | <10 ppm | Ba | <10 ppm |
| Mn | <10 ppm | Cr | <10 ppm |

The advantages afforded by the process in accordance with the invention are seen in that high-purity lithium metal can be produced in an economical manner in a structurally simple and inexpensive apparatus.

We claim:

1. A method of producing lithium metal comprising the steps of:

providing a ceramically unlined electrolysis cell having an upright tubular cathode separated from an anode centrally disposed within said cathode by an annular interelectrode space terminating at an upper end of said cathode in an annular trough for collecting a mixture of electrolyte and lithium metal, and an enclosure for said cathode forming an electrolyte space communicating with said interelectrode space near a bottom portion thereof and forming a compartment above said trough and said interelectrode space containing a chlorine gas atmosphere;

introducing an electrolyte of fused lithium chloride and potassium chloride into said enclosure so that said electrolyte passes into said interelectrode space;

electrolyzing said electrolyte in said cell to form a molten mixture of lithium metal and electrolyte rising in said interelectrode space and passing into said trough;

withdrawing said mixture from said trough downwardly through a siphon pipe and supplying the withdrawn molten mixture to a separating chamber in said enclosure upwardly by mechanically displacing said molten member upwardly from an upwardly open end of said siphon pipe communicating with said separating chamber, said separating chamber being sealed off from the chlorine gas atmosphere in said enclosure;

separating said molten mixture in said separating chamber into lithium metal and electrolyte while maintaining a protective gas mixture above the lithium metal in said chamber;

discharging the separated lithium metal from said separating chamber; and discharging separated electrolyte from said separating chamber into said enclosure for recycling to said cell.

2. An apparatus for the electrolytic production of lithium metal comprising:

a ceramically unlined steel enclosure sealed from the atmosphere;

a tubular cylindrical steel cathode welded to the bottom of said enclosure and extending upwardly therein, said cathode having openings proximal to the bottom thereof for communicating with the enclosure around said cathode;

an upright graphite anode disposed in said cathode and defining an interelectrode space therewith, said anode passing sealingly through a top of said enclosure, said anode and said cathode defining an electrolysis cell for electrolyzing a fused electrolyte consisting of lithium chloride and potassium chloride to produce in said interelectrode space, a rising molten mixture of lithium metal and electrolyte, means forming a collecting trough at an upper end of said cathode within said enclosure and below said top of said enclosure, said enclosure being provided with an outlet for evolved chlorine gas being assembled above the electrolyte in said enclosure and said mixture in said interelectrode space and said trough;

a siphon pipe having a long leg connected to a bottom of said trough and a short leg for discharging said mixture;

a tubular casing welded in said enclosure and surrounding said short leg to define a separating chamber in said enclosure sealed off from the chlorine gas atmosphere therein for separating said molten mixture into lithium metal and electrolyte, the lithium metal lying in a layer above said electrolyte in said separating chamber, said casing being provided with openings for discharging electrolyte into the enclosure around said casing for recycling to said cell;

mechanical means cooperating with said short leg for mechanically displacing said mixture upwardly therefrom into said separating chamber; and means for maintaining a protecting gas atmosphere above said layer of lithium metal in said separating chamber.

3. The apparatus defined in claim 2 wherein said short leg has a larger diameter upper portion, said mechanical means including a blade stirrer received in said larger diameter upper portion.

4. The apparatus defined in claim 3 wherein the ratio of the diameter of said pipe below said upper portion to the diameter of said upper portion is 1:2 to 1:12.

5. The apparatus defined in claim 4 wherein said ratio is 1:5 to 1:10.

6. The apparatus defined in claim 2, further comprising an electrically insulating fitting on the bottom of said enclosure for supporting said graphite anode.

* * * * *